US011846458B2

(12) United States Patent
Liu

(10) Patent No.: US 11,846,458 B2
(45) Date of Patent: Dec. 19, 2023

(54) CRYOCOOLER AND CONTROL METHOD OF CRYOCOOLER

(71) Applicant: SUMITOMO HEAVY INDUSTRIES, LTD., Tokyo (JP)

(72) Inventor: Changheng Liu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 129 days.

(21) Appl. No.: 17/486,894

(22) Filed: Sep. 27, 2021

(65) Prior Publication Data

US 2022/0107119 A1 Apr. 7, 2022

(30) Foreign Application Priority Data

Oct. 1, 2020 (JP) ..... 2020-167270

(51) Int. Cl.

| | |
|---|---|
| ***F25B 9/14*** | (2006.01) |
| ***F25B 9/10*** | (2006.01) |
| ***F25B 9/06*** | (2006.01) |
| ***F25B 41/22*** | (2021.01) |

(52) U.S. Cl.

CPC ..... *F25B 9/145* (2013.01); *F25B 9/06* (2013.01); *F25B 9/10* (2013.01); *F25B 41/22* (2021.01); *F25B 2309/001* (2013.01); *F25B 2309/1418* (2013.01); *F25B 2600/2501* (2013.01); *F25B 2600/2525* (2013.01)

(58) Field of Classification Search

CPC ..... F25B 9/10; F25B 9/06; F25B 9/14; F25B 9/145; F25B 2600/2501; F25B 2309/1418

See application file for complete search history.

(56) References Cited

U.S. PATENT DOCUMENTS

| | | | | |
|---|---|---|---|---|
| 2009/0019879 | A1* | 1/2009 | Kasahara | F25B 9/008 62/515 |
| 2015/0040596 | A1* | 2/2015 | Dresens | F25B 9/002 62/55.5 |
| 2019/0011169 | A1* | 1/2019 | Oikawa | F25B 49/02 |

FOREIGN PATENT DOCUMENTS

| | | | |
|---|---|---|---|
| JP | H0464869 | A | 2/1992 |
| JP | 2567196 | B2 | 12/1996 |
| JP | 2694377 | B2 | 12/1997 |
| JP | 2722731 | B2 | 3/1998 |
| JP | 3293161 | B2 | 6/2002 |
| JP | 2003279185 | A | 10/2003 |
| JP | 2004085048 | A * | 3/2004 |
| JP | 4445187 | B2 | 4/2010 |

* cited by examiner

*Primary Examiner* — Brian M King
(74) *Attorney, Agent, or Firm* — HEA LAW PLLC

(57) ABSTRACT

A cryocooler includes a compressor, an expander that includes a motor and is driven by the motor, an inverter that controls an operation frequency of the motor, a high pressure line that connects the compressor to the expander such that a working gas is supplied from the compressor to the expander, a low pressure line that connects the compressor to the expander such that a working gas is collected from the expander to the compressor, a pressure measurement unit that is configured to measure pressures of the high pressure line and the low pressure line or to measure a differential pressure between the high pressure line and the low pressure line, and a controller that compares the differential pressure to a target pressure and controls the inverter such that the operation frequency of the motor is increased when the differential pressure exceeds the target pressure.

4 Claims, 3 Drawing Sheets

CRYOCOOLER AND CONTROL METHOD OF CRYOCOOLER

RELATED APPLICATIONS

The content of Japanese Patent Application No. 2020-167270, on the basis of which priority benefits are claimed in an accompanying application data sheet, is in its entirety incorporated herein by reference.

BACKGROUND

Technical Field

Certain embodiments of the present invention relate to a cryocooler and a control method of a cryocooler.

Description of Related Art

A cryocooler is used in order to cool various target objects such as a superconducting device used in a cryogenic temperature environment, a measuring device, and a sample.

SUMMARY

According to an embodiment of the present invention, there is provided a cryocooler including a compressor, an expander that includes a motor and is driven by the motor, an inverter that controls an operation frequency of the motor, a high pressure line that connects the compressor to the expander such that a high pressure working gas is supplied from the compressor to the expander, a low pressure line that connects the compressor to the expander such that a low pressure working gas is collected from the expander to the compressor, a pressure measurement unit that is configured to measure a pressure of the high pressure line and a pressure of the low pressure line or to measure a differential pressure between the high pressure line and the low pressure line, and a controller that compares the differential pressure between the high pressure line and the low pressure line to a target pressure based on an output from the pressure measurement unit and controls the inverter such that the operation frequency of the motor is increased in a case where the differential pressure exceeds the target pressure.

According to another embodiment of the present invention, there is provided a control method of a cryocooler. The cryocooler includes a compressor, an expander that includes a motor and is driven by the motor, an inverter that controls an operation frequency of the motor, a high pressure line that connects the compressor to the expander such that a high pressure working gas is supplied from the compressor to the expander, and a low pressure line that connects the compressor to the expander such that a low pressure working gas is collected from the expander to the compressor. The present method includes measuring a differential pressure between the high pressure line and the low pressure line, comparing the measured differential pressure between the high pressure line and the low pressure line to a target pressure, and controlling the inverter such that the operation frequency of the motor is increased in a case where the differential pressure exceeds the target pressure.

Any combination of the components described above and a combination obtained by switching the components and expressions of the present invention between methods, devices, and systems are also effective as an embodiment of the present invention.

DETAILED DESCRIPTION

To cool a target object with a cryocooler, first, it is necessary to start the cryocooler and to cool the cryocooler from an initial temperature, such as the room temperature, to a target cryogenic temperature. This is also called cooldown of the cryocooler. Since the cooldown is merely preparation for beginning the cooling of the target object, it is desirable that time taken for the cooldown is as short as possible.

It is desirable to shorten the cooldown time of the cryocooler.

Hereinafter, an embodiment for carrying out the present invention will be described in detail with reference to the drawings. In the description and drawings, the same or equivalent components, members, and processing will be assigned with the same reference symbols, and redundant description thereof will be omitted as appropriate. The scales and shapes of shown parts are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
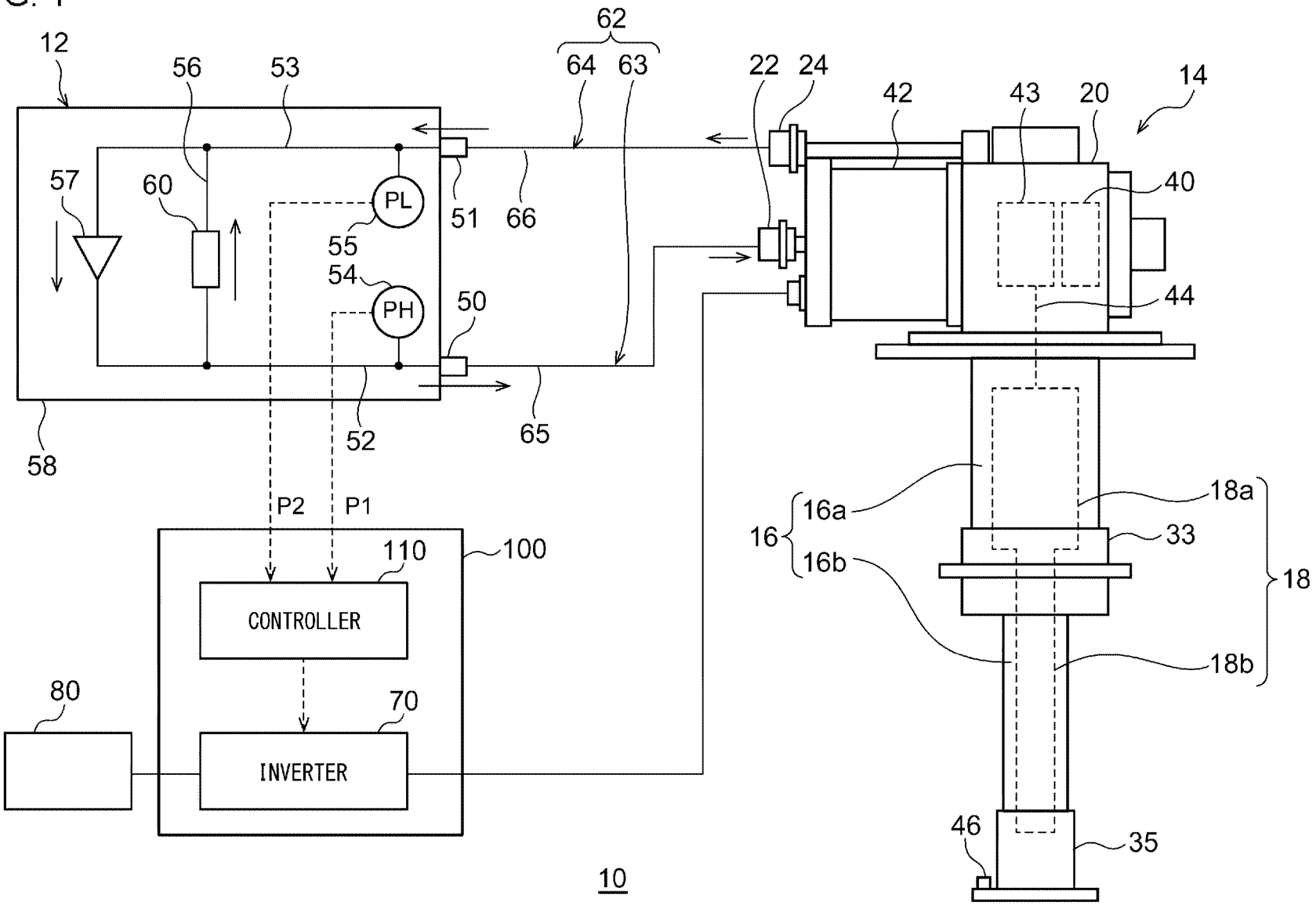
FIG. 1 is a view schematically showing a cryocooler according to an embodiment.
Figure 2:
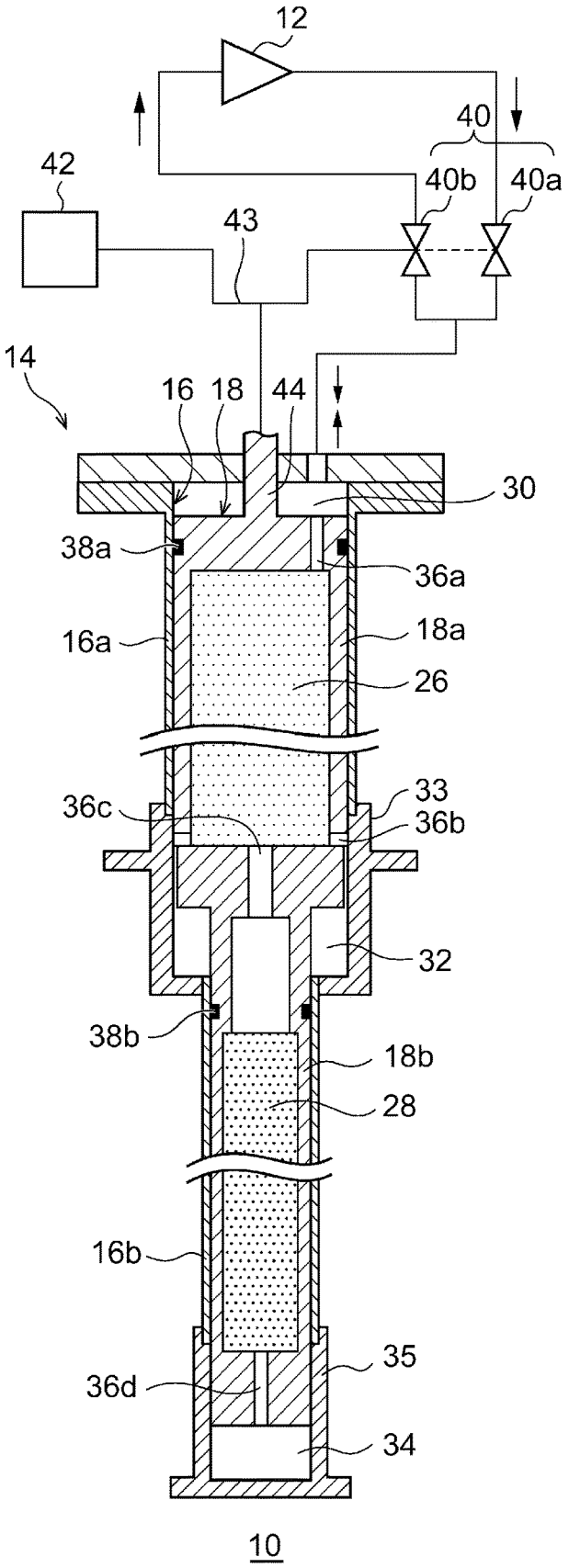
FIG. 2 is a view schematically showing the cryocooler according to the embodiment.

FIGS. 1 and 2 are views schematically showing a cryocooler 10 according to the embodiment. The cryocooler 10 is, for example, a two-stage type Gifford-McMahon (GM) cryocooler. FIG. 1 schematically shows a compressor 12 and an expander 14 that configure the cryocooler 10 together with a control device 100. FIG. 2 shows an internal structure of the expander 14 of the cryocooler 10.

The compressor 12 is configured to collect a working gas of the cryocooler 10 from the expander 14, to pressurize the collected working gas, and to supply the working gas to the expander 14 again. The compressor 12 and the expander 14 configure a refrigeration cycle of the cryocooler 10, and accordingly the cryocooler 10 can provide desired cryogenic temperature cooling. The expander 14 is also called a cold head. The working gas is also called a refrigerant gas, and other suitable gases may be used although a helium gas is typically used. To facilitate understanding, a direction in which the working gas flows is shown with arrows in FIG. 1.

In general, both of the pressure of a working gas to be supplied from the compressor 12 to the expander 14 and the pressure of a working gas to be collected from the expander 14 to the compressor 12 are considerably higher than the atmospheric pressure, and can be called a first high pressure and a second high pressure, respectively. For convenience of description, the first high pressure and the second high pressure are also simply called a high pressure and a low pressure, respectively. Typically, the high pressure is, for example, 2 to 3 MPa. The low pressure is, for example, 0.5 to 1.5 MPa, and is, for example, approximately 0.8 MPa. To facilitate understanding, a direction in which the working gas flows is shown with arrows.

The expander 14 includes a cryocooler cylinder 16 and a displacer assembly 18. The cryocooler cylinder 16 guides linear reciprocating motion of the displacer assembly 18 and forms expansion chambers (32 and 34) for the working gas with the displacer assembly 18. In addition, the expander 14 includes a pressure switching valve 40 that determines a timing when the working gas to the expansion chambers starts to be supplied and a timing when the working gas from the expansion chambers starts to be returned.

In the present specification, in order to describe a positional relationship between components of the cryocooler 10, for convenience of description, a side close to a top dead center of axial reciprocation of a displacer will be referred to as "up" and a side close to a bottom dead center will be referred to as "down". The top dead center is the position of the displacer at which the volume of an expansion space is maximum, and the bottom dead center is the position of the displacer at which the volume of the expansion space is minimum. Since a temperature gradient in which the temperature drops from an upper side to a lower side in an axial direction is generated during the operation of the cryocooler 10, the upper side can also be called a high temperature side and the lower side can also be called a low temperature side.

The cryocooler cylinder 16 includes a first cylinder 16*a* and a second cylinder 16*b*. The first cylinder 16*a* and the second cylinder 16*b* each are, for example, a member that has a cylindrical shape, and the second cylinder 16*b* has a diameter smaller than the first cylinder 16*a*. The first cylinder 16*a* and the second cylinder 16*b* are coaxially disposed, and a lower end of the first cylinder 16*a* is strongly connected to an upper end of the second cylinder 16*b*.

The displacer assembly 18 includes a first displacer 18*a* and a second displacer 18*b* that are connected to each other, and the displacers move integrally. The first displacer 18*a* and the second displacer 18*b* each are, for example, a member that has a cylindrical shape, and the second displacer 18*b* has a diameter smaller than the first displacer 18*a*. The first displacer 18*a* and the second displacer 18*b* are coaxially disposed.

The first displacer 18*a* is accommodated in the first cylinder 16*a*, and the second displacer 18*b* is accommodated in the second cylinder 16*b*. The first displacer 18*a* can reciprocate in the axial direction along the first cylinder 16*a*, and the second displacer 18*b* can reciprocate in the axial direction along the second cylinder 16*b*.

As shown in FIG. 2, the first displacer 18*a* accommodates a first regenerator 26. The first regenerator 26 is formed by filling a tubular main body portion of the first displacer 18*a* with, for example, a wire mesh made of, such as copper, or other appropriate first regenerator material. An upper lid portion and a lower lid portion of the first displacer 18*a* may be provided as members separate from the main body portion of the first displacer 18*a*, or the first regenerator material maybe accommodated in the first displacer 18*a* by fixing the upper lid portion and the lower lid portion of the first displacer 18*a* to the main body through appropriate means such as fastening and welding.

Similarly, the second displacer 18*b* accommodates a second regenerator 28. The second regenerator 28 is formed by filling a tubular main body portion of the second displacer 18*b* with, for example, a non-magnetic regenerator material such as bismuth, a magnetic regenerator material such as $HoCu_2$, or other appropriate second regenerator material. The second regenerator material may be molded into a granular shape. An upper lid portion and a lower lid portion of the second displacer 18*b* maybe provided as members separate from the main body portion of the second displacer 18*b*, or the second regenerator material may be accommodated in the second displacer 18*b* by fixing the upper lid portion and the lower lid portion of the second displacer 18*b* to the main body through appropriate means such as fastening and welding.

The displacer assembly 18 forms, inside the cryocooler cylinder 16, a room temperature chamber 30, a first expansion chamber 32, and a second expansion chamber 34. In order to exchange heat with a desired object or medium to be cooled by the cryocooler 10, the expander 14 includes a first cooling stage 33 and a second cooling stage 35. The room temperature chamber 30 is formed between the upper lid portion of the first displacer 18*a* and an upper portion of the first cylinder 16*a*. The first expansion chamber 32 is formed between the lower lid portion of the first displacer 18*a* and the first cooling stage 33. The second expansion chamber 34 is formed between the lower lid portion of the second displacer 18*b* and the second cooling stage 35. The first cooling stage 33 is fixed to a lower portion of the first cylinder 16*a* to surround the first expansion chamber 32, and the second cooling stage 35 is fixed to a lower portion of the second cylinder 16*b* to surround the second expansion chamber 34.

The first regenerator 26 is connected to the room temperature chamber 30 through a working gas flow path 36*a* formed in the upper lid portion of the first displacer 18*a*, and is connected to the first expansion chamber 32 through a working gas flow path 36*b* formed in the lower lid portion of the first displacer 18*a*. The second regenerator 28 is connected to the first regenerator 26 through a working gas flow path 36*c* formed from the lower lid portion of the first displacer 18*a* to the upper lid portion of the second displacer 18*b*. In addition, the second regenerator 28 is connected to the second expansion chamber 34 through a working gas flow path 36*d* formed in the lower lid portion of the second displacer 18*b*.

In order to introduce working gas flow between the first expansion chamber 32, the second expansion chamber 34, and the room temperature chamber 30 to the first regenerator 26 and the second regenerator 28 instead of a clearance between the cryocooler cylinder 16 and the displacer assembly 18, a first seal 38*a* and a second seal 38*b* may be provided. The first seal 38*a* may be mounted on the upper lid portion of the first displacer 18*a* to be disposed between the first displacer 18*a* and the first cylinder 16*a*. The second seal 38*b* may be mounted on the upper lid portion of the second displacer 18*b* to be disposed between the second displacer 18*b* and the second cylinder 16*b*.

As shown in FIG. 1, the expander 14 includes a cryocooler housing 20 that accommodates the pressure switching valve 40. The cryocooler housing 20 is coupled to the cryocooler cylinder 16, and accordingly a hermetic container that accommodates the pressure switching valve 40 and the displacer assembly 18 is configured.

As shown in FIG. 2, the pressure switching valve 40 is configured to include a high pressure valve 40*a* and a low pressure valve 40*b* and to generate periodic pressure fluctuations in the cryocooler cylinder 16. A working gas discharge port of the compressor 12 is connected to the room temperature chamber 30 via the high pressure valve 40*a*, and a working gas suction port of the compressor 12 is connected to the room temperature chamber 30 via the low pressure valve 40*b*. The high pressure valve 40*a* and the low pressure valve 40*b* are configured to open and close selectively and alternately (that is, such that when one is open, the other is closed).

The pressure switching valve 40 may take a form of a rotary valve. That is, the pressure switching valve 40 may be configured such that the high pressure valve 40*a* and the low pressure valve 40*b* are alternately opened and closed by rotational sliding of a valve disk with respect to a stationary valve main body. In this case, an expander motor 42 may be connected to the pressure switching valve 40 to rotate the valve disk of the pressure switching valve 40. For example, the pressure switching valve 40 is disposed such that a valve rotation axis is coaxial with a rotation axis of the expander motor 42.

Alternatively, the high pressure valve 40*a* and the low pressure valve 40*b* each may be a valve that can be individually controlled, and in this case, the pressure switching valve 40 may not be connected to the expander motor 42.

For example, the expander motor 42 is connected to a displacer drive shaft 44 via a motion conversion mechanism 43 such as a scotch yoke mechanism. The expander motor 42 is attached to the cryocooler housing 20. The motion conversion mechanism 43 is accommodated in the cryocooler housing 20 like the pressure switching valve 40. The motion conversion mechanism 43 converts a rotating motion output by the expander motor 42 into linear reciprocating motion of the displacer drive shaft 44. The displacer drive shaft 44 extends from the motion conversion mechanism 43 into the room temperature chamber 30, and is fixed to the upper lid portion of the first displacer 18*a*. The rotation of the expander motor 42 is converted into the axial reciprocation of the displacer drive shaft 44 by the motion conversion mechanism 43, and the displacer assembly 18 linearly reciprocates in the axial direction in the cryocooler cylinder 16.

The expander motor 42 is, for example, a permanent magnet type motor driven by a three-phase alternating current. The operation frequency of the expander motor 42 is controlled by an inverter 70. The expander motor 42 can operate at a rotation speed according to the operation frequency of the expander motor 42, which corresponds to the output frequency of the inverter 70. For example, the output frequency of the inverter 70 can change within a range of 30 Hz to 100 Hz or a range of 40 Hz to 70 Hz.

The expander motor 42 and the inverter 70 are supplied with power from an external power source 80 such as a commercial power source (three-phase alternating current power source). The expander motor 42 and the inverter 70 may be, for example, supplied with power by being connected to the external power source 80 via the compressor 12, and in this case, the compressor 12 may be considered as a power source for the expander motor 42 and the inverter 70.

In addition, the expander 14 may include a temperature sensor 46 that measures the temperature of the second cooling stage 35 (and/or the first cooling stage 33) and outputs a measured temperature signal indicating the measured temperature.

The compressor 12 includes a high pressure gas outlet 50, a low pressure gas inlet 51, a high pressure flow path 52, a low pressure flow path 53, a first pressure sensor 54, a second pressure sensor 55, a bypass line 56, a compressor main body 57, and a compressor casing 58. The high pressure gas outlet 50 is provided in the compressor casing 58 as a working gas discharge port of the compressor 12, and the low pressure gas inlet 51 is provided in the compressor casing 58 as a working gas suction port of the compressor 12. The high pressure flow path 52 connects a discharge port of the compressor main body 57 to the high pressure gas outlet 50, and the low pressure flow path 53 connects the low pressure gas inlet 51 to a suction port of the compressor main body 57. The compressor casing 58 accommodates the high pressure flow path 52, the low pressure flow path 53, the first pressure sensor 54, the second pressure sensor 55, the bypass line 56, and the compressor main body 57. The compressor 12 is also called a compressor unit.

The compressor main body 57 is configured to internally compress the working gas sucked from the suction port and to discharge the working gas from the discharge port. The compressor main body 57 may be, for example, a scroll type pump, a rotary type pump, or other pumps that pressurize the working gas. In the embodiment, the compressor main body 57 is configured to discharge the working gas at a fixed and constant flow rate. Alternatively, the compressor main body 57 may be configured to change the flow rate of the working gas to be discharged. The compressor main body 57 is called a compression capsule in some cases.

The first pressure sensor 54 is disposed in the high pressure flow path 52 to measure the pressure of the working gas flowing in the high pressure flow path 52. The first pressure sensor 54 is configured to output a first measured pressure signal P1 indicating the measured pressure. The second pressure sensor 55 is disposed in the low pressure flow path 53 to measure the pressure of the working gas flowing in the low pressure flow path 53. The second pressure sensor 55 is configured to output a second measured pressure signal P2 indicating the measured pressure. Accordingly, the first pressure sensor 54 and the second pressure sensor 55 can also be called a high pressure sensor and a low pressure sensor, respectively. In addition, in the present specification, any one of the first pressure sensor 54 and the second pressure sensor 55 or both of the first pressure sensor and the second pressure sensor will be collectively and simply referred to as a "pressure sensor" in some cases.

The bypass line 56 connects the high pressure flow path 52 to the low pressure flow path 53 such that the working gas bypasses the expander 14 and returns from the high pressure flow path 52 to the low pressure flow path 53. A relief valve 60 for opening and closing the bypass line 56 and controlling the flow rate of the working gas flowing in the bypass line 56 is provided in the bypass line 56. The relief valve 60 is configured to open when a differential pressure that is equal to or higher than a set pressure acts between an inlet and an outlet thereof. The relief valve 60 may be an on/off valve or a flow rate control valve, or may be, for example, a solenoid valve. It is possible to set the set pressure as appropriate based on empirical knowledge of a designer or experiments and simulations by the designer. Accordingly, a differential pressure between a high pressure line 63 and a low pressure line 64 can be prevented from exceeding the set pressure and becoming excessive.

For example, the relief valve 60 may be opened and closed under the control of the control device 100. The control device 100 may compare a differential pressure between the high pressure line 63 and the low pressure line 64, which is to be measured, to the set pressure, and control the relief valve 60 such that the relief valve 60 is opened in a case where the measured differential pressure is equal to or higher than the set pressure, and the relief valve 60 is closed in a case where the measured differential pressure is lower than the set pressure. The control device 100 may acquire the measured differential pressure between the high pressure line 63 and the low pressure line 64 based on the first measured pressure signal P1 from the first pressure sensor 54 and the second measured pressure signal P2 from the second pressure sensor 55. As another example, the relief valve 60 may be configured to operate as a so-called safety valve, that is, may be mechanically opened when the differential pressure that is equal to or higher than the set pressure acts between the inlet and the outlet.

The compressor 12 can include other various components. For example, an oil separator or an adsorber may be provided in the high pressure flow path 52. A storage tank and other components may be provided in the low pressure flow path 53. In addition, an oil circulation system that cools the compressor main body 57 with an oil and a cooling system that cools the oil may be provided in the compressor 12.

In addition, the cryocooler 10 includes a gas line 62 that circulates the working gas between the compressor 12 and the expander 14. The gas line 62 includes the high pressure line 63 that connects the compressor 12 to the expander 14 such that the working gas is supplied from the compressor 12 to the expander 14 and the low pressure line 64 that connects the compressor 12 to the expander 14 such that the working gas is collected from the expander 14 to the compressor 12. A high pressure gas inlet 22 and a low pressure gas outlet 24 are provided in the cryocooler housing 20 of the expander 14. The high pressure gas inlet 22 is connected to the high pressure gas outlet 50 by a high-pressure pipe 65, and the low pressure gas outlet 24 is connected to the low pressure gas inlet 51 by a low-pressure pipe 66. The high pressure line 63 is formed by the high-pressure pipe 65 and the high pressure flow path 52, and the low pressure line 64 is formed by the low-pressure pipe 66 and the low pressure flow path 53. The bypass line 56 may be considered to be a part of the gas line 62. The bypass line 56 connects the high pressure line 63 to the low pressure line 64 such that the working gas bypasses the expander 14 and returns from the high pressure line 63 to the low pressure line 64.

Therefore, the working gas to be collected from the expander 14 to the compressor 12 enters the low pressure gas inlet 51 of the compressor 12 from the low pressure gas outlet 24 of the expander 14 through the low-pressure pipe 66, and further returns to the compressor main body 57 via the low pressure flow path 53 so as to be compressed and pressurized by the compressor main body 57. The working gas to be supplied from the compressor 12 to the expander 14 exits from the high pressure gas outlet 50 of the compressor 12 through the high pressure flow path 52 from the compressor main body 57, and is further supplied to the expander 14 via the high-pressure pipe 65 and the high pressure gas inlet 22 of the expander 14.

When a differential pressure between the high pressure line 63 and the low pressure line 64 exceeds the set pressure of the relief valve 60 and the relief valve 60 is open, some of the working gas flowing in the high pressure line 63 is diverted from the high pressure flow path 52 to the bypass line 56. Since the bypass line 56 joins the low pressure flow path 53, the working gas bypasses the expander 14 and returns to the compressor main body 57, and the differential pressure between the high pressure line 63 and the low pressure line 64 decreases. Accordingly, when the differential pressure falls below the set pressure of the relief valve 60, the relief valve 60 is closed, and working gas flow from the high pressure line 63 to the low pressure line 64 through the bypass line 56 is blocked.

As shown in FIG. 1, the control device 100 that controls the cryocooler 10 includes a controller 110 that controls the inverter 70. The controller 110 is electrically connected to the first pressure sensor 54 and the second pressure sensor 55 to acquire the first measured pressure signal P1 and the second measured pressure signal P2. In addition, the controller 110 is electrically connected to the temperature sensor 46 to acquire a measured temperature signal from the temperature sensor 46.

Although details will be described later, the controller 110 compares a differential pressure between the high pressure line 63 and the low pressure line 64 to a target pressure based on the first measured pressure signal P1 and the second measured pressure signal P2, and controls the inverter 70 such that the operation frequency of the expander motor 42 is increased in a case where the differential pressure exceeds the target pressure and the operation frequency of the expander motor 42 is decreased in a case where the differential pressure falls below the target pressure.

Although the control device 100 is provided separately from the compressor 12 and the expander 14 and is connected thereto in the example shown, the invention is not limited thereto. The control device 100 may be mounted on the compressor 12. The control device 100 may be provided in the expander 14 such as being mounted on the expander motor 42. Alternatively, the controller 110 and the inverter 70 may be provided separately from each other such as the controller 110 is mounted on the compressor 12 and the inverter 70 is mounted on the expander 14.

The control device 100 is realized by an element or a circuit including a CPU and a memory of a computer as a hardware configuration and is realized by a computer program as a software configuration, but is shown in FIG. 1 as a functional block realized in cooperation therewith. It is clear for those skilled in the art that the functional blocks can be realized in various manners in combination with hardware and software.

When the compressor 12 and the expander motor 42 are operated, the cryocooler 10 causes periodic volume fluctuations in the first expansion chamber 32 and the second expansion chamber 34 and pressure fluctuations of the working gas in synchronization therewith. Typically, in a supplying process, as the low pressure valve 40*b* is closed and the high pressure valve 40*a* is opened, a high pressure working gas flows from the compressor 12 into the room temperature chamber 30 through the high pressure valve 40*a*, is supplied to the first expansion chamber 32 through the first regenerator 26, and is supplied to the second expansion chamber 34 through the second regenerator 28. In this manner, the first expansion chamber 32 and the second expansion chamber 34 are pressurized from a low pressure to a high pressure. In this case, the displacer assembly 18 is moved upward from the bottom dead center to the top dead center, and the volumes of the first expansion chamber 32 and the second expansion chamber 34 are increased. When the high pressure valve 40*a* is closed, the supplying process ends.

In a returning process, since the high pressure first expansion chamber 32 and the high pressure second expansion chamber 34 are opened to the low pressure working gas suction port of the compressor 12, as the high pressure valve 40*a* is closed and the low pressure valve 40*b* is opened, the working gas is expanded by the first expansion chamber 32 and the second expansion chamber 34, and the working gas which has a low pressure as a result is returned from the first expansion chamber 32 and the second expansion chamber 34 to the room temperature chamber 30 through the first regenerator 26 and the second regenerator 28. In this case, the displacer assembly 18 is moved downward from the top dead center to the bottom dead center, and the volumes of the first expansion chamber 32 and the second expansion chamber 34 are decreased. The working gas is collected from the expander 14 to the compressor 12 through the low pressure valve 40*b*. When the low pressure valve 40*b* is closed, the returning process ends.

In this manner, for example, a refrigeration cycle such as a GM cycle is configured, and the first cooling stage 33 and the second cooling stage 35 are cooled to a desired cryogenic temperature. The first cooling stage 33 can be cooled to a first cooling temperature within a range of, for example, approximately 20 K to approximately 40 K. The second cooling stage 35 can be cooled to a second cooling temperature (for example, approximately 1 K to approximately 4 K) lower than the first cooling temperature.

The cryocooler 10 can perform steady operation and cooldown operation prior to the steady operation. The cooldown operation is an operation mode in which the cryocooler is rapidly cooled from the room temperature to a cryogenic temperature when the cryocooler 10 is started. The steady operation is an operation mode of the cryocooler 10 in which a state where the cryocooler is cooled to the cryogenic temperature through the cooldown operation is maintained. The cryocooler 10 is cooled to a standard cooling temperature through the cooldown operation, and is maintained within an allowable temperature range of a cryogenic temperature including the standard cooling temperature in the steady operation. The standard cooling temperature varies according to the application and setting of the cryocooler 10, but is typically, for example, approximately 4.2 K or lower in the cooling application of a superconductive device. In some other cooling applications, the standard cooling temperature may be, for example, approximately 10 K to 20 K, or may be 10 K or lower. Switching from the cooldown operation to the steady operation may be controlled by the control device 100. For example, the control device 100 may compare the measured temperature of the second cooling stage 35 (and/or the first cooling stage 33) to the standard cooling temperature described above based on a measured temperature signal from the temperature sensor 46, and may execute the cooldown operation in a case where the measured temperature is higher than the standard cooling temperature and proceed from the cooldown operation to the steady operation in a case where the measured temperature is equal to or lower than the standard cooling temperature.

Figure 3:
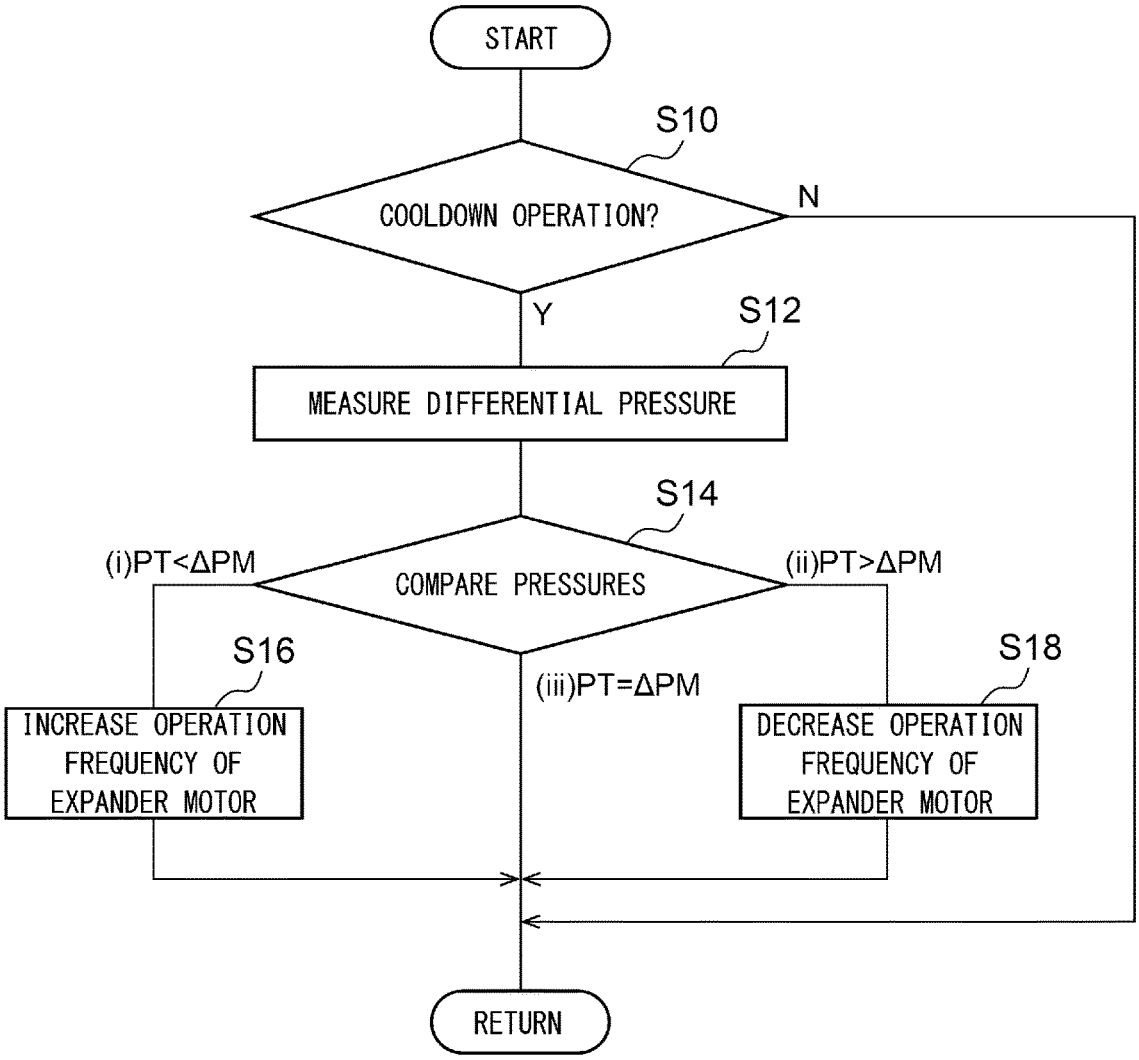
FIG. 3 is a flowchart showing a control method of a cryocooler according to the embodiment.

FIG. 3 is a flowchart showing a control method of the cryocooler 10 according to the embodiment. The present method is repeatedly executed at a predetermined cycle by the controller 110 during the operation of the cryocooler 10. The present method can also be called accelerated cooling of the cryocooler 10, and the accelerated cooling is executed at least in the cooldown operation.

Thus, as shown in FIG. 3, in the present method, first, whether or not the current operation mode of the cryocooler 10 is the cooldown operation is determined (S10). The controller 110 may determine whether or not the current operation mode is the cooldown operation based on information indicating the current operation mode of the cryocooler 10. The information indicating the current operation mode may be stored in the controller 110 as a result of switching processing between the cooldown operation and the steady operation.

In a case where the current operation mode is the cooldown operation (Y of S10), a differential pressure between the high pressure line 63 and the low pressure line 64 is measured (S12). The differential pressure is measured using a pressure measurement unit of the cryocooler 10, for example, the first pressure sensor 54 and the second pressure sensor 55 as described above. The controller 110 acquires a measured differential pressure ΔPM between the high pressure line 63 and the low pressure line 64 from the first measured pressure signal P1 and the second measured pressure signal P2.

Next, the measured differential pressure ΔPM between the high pressure line 63 and the low pressure line 64 is compared to a target pressure PT (S14). The value of the target pressure PT is set to a pressure value smaller than the set pressure described above, at which the relief valve 60 opens. However, the target pressure PT may be set to a pressure value as close as possible to the set pressure, and for example, a difference between the target pressure PT and the set pressure may be within 0.1 MPa. The target pressure PT may be, for example, 0.03 MPa to 0.07 MPa smaller than the set pressure, or may be, for example, 0.05 MPa smaller. In a case where the set pressure of the relief valve 60 is, for example, 1.6 MPa, the target pressure PT may be, for example, smaller than 1.6 MPa and be equal to or larger than 1.5 MPa. The target pressure PT may be, for example, within a range of 1.53 MPa to 1.57 MPa, or for example, may be 1.55 MPa. It is possible to set the target pressure PT as appropriate based on empirical knowledge of the designer or experiments and simulations by the designer. The target pressure PT is input to the controller 110 in advance by a user of the cryocooler 10, or is automatically set by the controller 110 and is stored in the controller 110.

The controller 110 compares the measured differential pressure ΔPM to the target pressure PT and outputs a relationship as to which one of the measured differential pressure and the target pressure is larger or smaller as a comparison result. That is, the comparison result from the controller 110 indicates any one of the following three states. (i) The measured differential pressure ΔPM is larger than the target pressure PT. (ii) The measured differential pressure ΔPM is smaller than the target pressure PT. (iii) The measured differential pressure ΔPM is equal to the target pressure PT.

The inverter 70 is controlled based on the comparison result from the controller 110, and the operation frequency of the expander motor 42 is controlled in accordance with the output frequency of the inverter 70. Specifically, (i) in a case where the measured differential pressure ΔPM is larger than the target pressure PT, the controller 110 controls the inverter 70 such that the operation frequency of the expander motor 42 is increased (S16). (ii) In a case where the measured differential pressure ΔPM is smaller than the target pressure PT, the controller 110 controls the inverter 70 such that the operation frequency of the expander motor 42 is decreased (S18). (iii) In a case where the measured differential pressure ΔPM is equal to the target pressure PT, the controller 110 controls the inverter 70 such that the current operation frequency is maintained since it is not necessary to increase or decrease the operation frequency of the expander motor 42. The case of (iii) may be included in either (i) or (ii).

As an alternative, the target pressure PT maybe different between a case where the operation frequency of the expander motor 42 is increased and a case where the operation frequency is decreased. For example, in a case where the measured differential pressure ΔPM is larger than a first target pressure PT1, the controller 110 may control the inverter 70 such that the operation frequency of the expander motor 42 is increased. In a case where the measured differential pressure ΔPM is smaller than a second target pressure PT2, the controller 110 may control the inverter 70 such that the operation frequency of the expander motor 42 is decreased. The second target pressure PT2 may be smaller than the first target pressure PT1. In a case where the measured differential pressure ΔPM is between the first target pressure PT1 and the second target pressure PT2, the controller 110 may control the inverter 70 such that the current operation frequency of the expander motor 42 is maintained.

When the operation frequency of the expander motor 42 is increased or decreased, the controller 110 may increase or decrease the operation frequency by a predetermined amount from the value of the current operation frequency of the expander motor 42. However, in a case where the value of the current operation frequency has already reached an upper limit when the operation frequency is about to be increased, the controller 110 may maintain the upper limit without increasing the operation frequency. For example, in a case where the range of the operation frequency of the expander motor 42 is 30 Hz to 100 Hz and the current value is already the upper limit of 100 Hz, the controller 110 can maintain 100 Hz without further increasing the operation frequency from 100 Hz. Similarly, in a case where the value of the current operation frequency has already reached a lower limit when the operation frequency is about to be decreased, the controller 110 may maintain the lower limit without decreasing the operation frequency.

Alternatively, the controller 110 may control the inverter 70 such that the operation frequency of the expander motor 42 is adjusted (for example, through feedback-control such as PID control) to minimize the deviation of the measured differential pressure ΔPM from the target pressure PT (may be the first target pressure PT1 or the second target pressure PT2). In this manner, the controller 110 may compare the differential pressure between the high pressure line 63 and the low pressure line 64 to the target pressure, and control the inverter 70 such that the operation frequency of the expander motor 42 is increased in a case where the differential pressure exceeds the target pressure and the operation frequency of the expander motor 42 is decreased in a case where the differential pressure falls below the target pressure.

In this manner, in a case where the measured differential pressure ΔPM exceeds the target pressure PT, the operation frequency of the expander motor 42 is increased. Since the flow rate of the working gas to be used in cooling at the expander 14 increases when the operation frequency increases, the measured differential pressure ΔPM decreases and approaches the target pressure PT, or falls below the target pressure PT when the discharge flow rate of the compressor 12 is constant (or sufficiently low even if the discharge flow rate has fluctuated). In addition, in a case where the measured differential pressure ΔPM falls below the target pressure PT, the operation frequency of the expander motor 42 is decreased. Since the flow rate of the working gas to be used at the expander 14 decreases, the measured differential pressure ΔPM increases and approaches the target pressure PT, or exceeds the target pressure PT.

In the embodiment, in a case where the current operation mode is not the cooldown operation (the current operation mode is, for example, the steady operation) (N of S10), the controller 110 does not execute accelerated cooling. In a case where the current operation mode is the steady operation, the operation frequency of the expander motor 42 may be fixed at, for example, a constant value such as an input frequency from the external power source 80 to the inverter 70 or a value lower than the input frequency. Alternatively, in a case where the current operation mode is the steady operation, the temperature control of the cryocooler 10 may be executed, for example, the inverter 70 may be controlled such that the operation frequency of the expander motor 42 is adjusted (for example, through feedback-control such as PID control) to minimize the deviation of the measured temperature from the target temperature (for example, the standard cooling temperature described above) based on a measured temperature signal from the temperature sensor 46.

However, in a case where the measured differential pressure ΔPM increases and exceeds the set pressure of the relief valve 60 during the operation of the cryocooler 10, the relief valve 60 opens, an excess working gas returns through the bypass line 56, and the returning working gas does not contribute to cryogenic temperature cooling at the expander 14. Since the flow rate of the working gas necessary for the expander 14 in order for the cryocooler 10 to output at a predetermined cooling capacity is correlated with a change in the density of the working gas depending on a cooling temperature, the lower the flow rate of the working gas, the higher the temperature, which is preferable. For this reason, when the discharge flow rate of the compressor 12 is constant, the higher the cooling temperature, the higher the flow rate of the excess working gas, and the measured differential pressure ΔPM tends to increase. Therefore, in particular, when the cryocooler 10 is started, that is, during the cooldown operation, a large amount of excess gas returns through the bypass line 56 and can become wasted.

On the other hand, in the accelerated cooling of the cryocooler 10 according to the embodiment, the operation frequency of the expander motor 42 is increased in a case where the measured differential pressure ΔPM exceeds the target pressure PT, and the flow rate of the excess working gas can be used in cryogenic temperature cooling at the expander 14. Since an increase in the operation frequency of the expander motor 42 precisely corresponds to an increase in the number of times of the refrigeration cycle of the cryocooler 10 per unit time, the cooling capacity of the cryocooler 10 can be increased. Since the flow rate of the excess working gas increases in the cooldown operation, the accelerated cooling is suitable for increasing the cooling capacity of the cryocooler 10 in the cooldown operation. Therefore, in the embodiment, the cooldown time of the cryocooler 10 can be shortened.

In general, since the cooling capacity of the cryocooler 10 can fluctuate proportionally to the measured differential pressure ΔPM, a decrease in the measured differential pressure ΔPM can result in a decrease in the cooling capacity. However, in the embodiment, in a case where the measured differential pressure ΔPM falls below the target pressure PT, the operation frequency of the expander motor 42 is decreased. Accordingly, since the flow rate of the working gas to be used at the expander 14 decreases and the measured differential pressure ΔPM is recovered, a decrease in the cooling capacity can be prevented or alleviated.

In addition, in the embodiment, the target pressure PT is set to a pressure value smaller than the set pressure of the relief valve 60. In this manner, since the target pressure PT is reached before reaching the set pressure of the relief valve 60 when the measured differential pressure ΔPM increases, the cooling capacity of the cryocooler 10 can be increased by increasing the operation frequency of the expander motor 42 without opening the relief valve 60 (that is, without wastingly returning an excess gas).

Further, a difference between the target pressure PT and the set pressure is within 0.1 MPa. In this manner, in a state where the relief valve 60 is closed, a differential pressure between the high pressure line 63 and the low pressure line 64 can be maintained as high as possible, and the cooling capacity of the cryocooler 10 can be increased.

In the embodiment described above, the accelerated cooling of the cryocooler 10 is performed in the cooldown operation. However, the accelerated cooling may be performed not only in the cooldown operation but also in the steady operation. In a case where the accelerated cooling is performed during the steady operation, Step S10 in the flow shown in FIG. 3, that is, a step of determining the current operation mode of the cryocooler 10 may be omitted.

Alternatively, the controller 110 may determine the current operation mode of the cryocooler 10, and control the inverter 70 such that in a case where the cryocooler 10 is in the cooldown operation, the operation frequency of the expander motor 42 is increased compared to a case where the cryocooler is during the steady operation. The operation frequency of the expander motor 42 in the cooldown operation may be higher than the input frequency (for example, 50 Hz or 60 Hz) from the external power source 80 to the inverter 70, or the operation frequency of the expander motor 42 in the steady operation maybe equal to or lower than the input frequency.

For example, the controller 110 may control the operation frequency of the expander motor 42 within a first range in the cooldown operation, and control the operation frequency of the expander motor 42 within a second range in the steady operation. The second range maybe an operation frequency lower than the first range. Alternatively, the controller 110 may control the operation frequency of the expander motor 42 from a first initial value in the cooldown operation, and control the operation frequency of the expander motor 42 from a second initial value in the steady operation. The second initial value may be an operation frequency lower than the first initial value. The first range (or the first initial value) may be higher than the input frequency to the inverter 70, and the second range (or the second initial value) may be equal to or lower than the input frequency to the inverter 70.

In the embodiment described above, the first pressure sensor 54 and the second pressure sensor 55 are used as pressure measurement units for measuring a differential pressure between the high pressure line 63 and the low pressure line 64. However, in one embodiment, for example, a differential pressure sensor provided in the bypass line 56 or the relief valve 60 may be used as a pressure measurement unit.

The pressure measurement units such as the first pressure sensor 54 and the second pressure sensor 55 are not necessarily provided in the compressor 12, and may be provided at any place where the pressure can be measured, such as the gas line 62 and the expander 14. For example, the first pressure sensor 54 may be provided at any place in the high pressure line 63, and the second pressure sensor 55 may be provided at anyplace in the low pressure line 64. In addition, similarly, the bypass line 56 and the relief valve 60 are not necessarily provided in the compressor 12 as well, and maybe disposed outside the compressor 12 and connect the high pressure line 63 to the low pressure line 64.

In the embodiment described above, the compressor 12 is configured to discharge the working gas at a fixed and constant flow rate. However, in one embodiment, the compressor 12 may be configured to change the discharge flow rate of the working gas. In this case, the controller 110 may execute the accelerated cooling described above when the compressor 12 is controlled such that the working gas is discharged at a constant flow rate. Alternatively, the controller 110 may control the compressor 12 such that the operation frequency of the expander motor 42 is maintained (or increased) in a case where the measured differential pressure ΔPM falls below the target pressure PT, and the discharge flow rate of the working gas of the compressor 12 increases.

Although a case where the cryocooler 10 is a two-stage type GM cryocooler has been described as an example in the embodiment described above, the invention is not limited thereto. The cryocooler 10 may be a single-stage type or a multi-stage type GM cryocooler, and may be other type of cryocooler including an expander motor that drives an expander, for example, a GM type pulse tube cryocooler.

The present invention has been described hereinbefore based on the examples. It is clear for those skilled in the art that the present invention is not limited to the embodiment, various design changes are possible, various modification examples are possible, and such modification examples are also within the scope of the present invention.

It should be understood that the invention is not limited to the above-described embodiment, but may be modified into various forms on the basis of the spirit of the invention. Additionally, the modifications are included in the scope of the invention.

What is claimed is:

1. A cryocooler comprising:
- a compressor;
- an expander that includes a motor and is driven by the motor;
- an inverter that controls an operation frequency of the motor;
- a high pressure line that connects the compressor to the expander such that a high pressure working gas is supplied from the compressor to the expander;
- a low pressure line that connects the compressor to the expander such that a low pressure working gas is collected from the expander to the compressor;
- a pressure sensor that is configured to measure a pressure of the high pressure line and a pressure of the low pressure line or to measure a differential pressure between the high pressure line and the low pressure line;
- a controller that compares the differential pressure between the high pressure line and the low pressure line to a target pressure based on an output from the pressure sensor, and the controller controls the inverter such that the operation frequency of the motor is increased when the differential pressure exceeds the target pressure,
- a bypass line that connects the high pressure line to the low pressure line; and
- relief valve that is provided in a bypass line and opens when the differential pressure, which is equal to or higher than a set pressure, acts between an inlet and an outlet of the relief valve,
- wherein the target pressure is smaller than the set pressure.

2. The cryocooler according to claim 1,
- wherein the controller controls the inverter such that the operation frequency of the motor is decreased when the differential pressure falls below the target pressure.

3. The cryocooler according to claim 1,
- wherein a difference between the target pressure and the set pressure is within 0.1 MPa.

4. A control method of a cryocooler, the cryocooler including a compressor, an expander that includes a motor and is driven by the motor, an inverter that controls an operation frequency of the motor, a high pressure line that connects the compressor to the expander such that a high pressure working gas is supplied from the compressor to the expander, a low pressure line that connects the compressor to the expander such that a low pressure working gas is collected from the expander to the compressor, a bypass line that connects the high pressure line to the low pressure line, and a relief valve that is provided in the bypass line, the method comprising;

measuring a differential pressure between the high pressure line and the low pressure line;

comparing the measured differential pressure between the high pressure line and the low pressure line to a target pressure; and controlling the inverter such that the operation frequency of the motor is increased when the differential pressure exceeds the target pressure, wherein the relief valve is opened when the differential pressure, which is equal to or higher than a set pressure, acts between an inlet and an outlet of the relief valve.

* * * * *